US006076286A

United States Patent [19]

Donnadieu

[11] Patent Number: 6,076,286

[45] **Date of Patent: *Jun. 20, 2000**

[54] SPORT BOOT

[75] Inventor: Thierry Donnadieu, Annecy-le-Vieux, France

[73] Assignee: Salomon S.A., Metz-Tessy, France

[ * ] Notice: This patent is subject to a terminal disclaimer.

[21] Appl. No.: 09/229,889

[22] Filed: Jan. 14, 1999

Related U.S. Application Data

[63] Continuation of application No. 08/785,300, Jan. 21, 1997, Pat. No. 5,884,420.

[30] Foreign Application Priority Data

Jan. 30, 1996 [FR] France ..... 96 01250

[51] Int. Cl.[7] ..... A43B 5/04

[52] U.S. Cl. ..... 36/117.5; 36/115; 36/117.2

[58] Field of Search ..... 36/117.2, 117.5, 36/117.3, 68, 115, 69, 102

[56] References Cited

U.S. PATENT DOCUMENTS

| | | | |
|---|---|---|---|
| 3,807,062 | 4/1974 | Spier . | |
| 3,842,518 | 10/1974 | Famolare, Jr. . | |
| 4,287,675 | 9/1981 | Norton et al. | 36/129 |
| 4,314,411 | 2/1982 | Hanson . | |
| 4,704,808 | 11/1987 | Bianchini et al. | 36/102 |
| 4,821,430 | 4/1989 | Flemming et al. | 36/69 |
| 4,852,275 | 8/1989 | Bianchini et al. | 36/102 |
| 5,177,884 | 1/1993 | Rullier . | |
| 5,218,773 | 6/1993 | Beckman . | |
| 5,438,769 | 8/1995 | Mazzarolo . | |
| 5,446,976 | 9/1995 | Donnadieu et al. | 36/117 |
| 5,499,461 | 3/1996 | Danezin et al. | 36/117 |
| 5,566,475 | 10/1996 | Donnadieu | 36/55 |
| 5,678,330 | 10/1997 | Van Dyke et al. . | |
| 5,884,420 | 3/1999 | Donnadieu . | |

FOREIGN PATENT DOCUMENTS

| | | |
|---|---|---|
| 0257496 | 3/1988 | European Pat. Off. . |
| 0309437 | 3/1989 | European Pat. Off. . |

*Primary Examiner*—Ted Kavanaugh
*Attorney, Agent, or Firm*—Greenblum & Bernstein, P.L.C.

[57] ABSTRACT

A boot especially adapted to sports that require movement of the foot, or to gliding sports, including an upper provided with a rear stiffener surrounding the heel and an external sole. According to the invention, the stiffener is rigid and substantially non-flexible, and extends along at least one side of the boot, up to the so-called metatarsophalangeal bending zone. According to a second aspect of the invention, the stiffener is rigid and substantially non-flexible, and surrounds the heel and essentially the rear portion of the base of the foot, in the manner of a shell. This construction also allows for a better transmission of the forces, while maintaining a flexibility of the boot in the metatarsophalangeal zone, due to the reinforcement of the rear portion of the boot. These constructions permit a better control of the ski through the heel retention and, at the same time, a general gain of energy by eliminating the parasitic deformations of the sole and of the boot.

21 Claims, 3 Drawing Sheets

8
6
7
1
13
14
2
23
22
3
11
5
21
4
12
24
9

8
6
7
1
13
14
2
25
22
3
11
15
4
12
9
16

SPORT BOOT

CROSS-REFERENCE TO RELATED APPLICATIONS

This is a continuation of application Ser. No. 08/785,300, filed on Jan. 21, 1997 now U.S. Pat. No. 5,884,420 , the disclosure of which is hereby incorporated by reference thereto in its entirety and the priority of which is claimed under 35 USC 120.

This application is also based upon French application No. 96.01250, filed on Jan. 30, 1996, the disclosure of which is hereby incorporated by reference thereto in its entirety and priority of which is hereby claimed under 35 USC 119.

BACKGROUND OF THE INVENTION

1.Field of the Invention

The present invention relates to a boot adapted to sports that require movement of the foot, such as snowshoeing, conventional or skating style cross-country skiing, telemark skiing, and hiking, and/or to gliding sports such as snowboarding, ice skating, and roller skating, i.e., sports that require a good transmission of the forces exerted by the foot for a better grip and edge setting.

2. Description of Background and Relevant Information

In all of the aforementioned sports, it is necessary to transmit the forces coming from the user's leg via the ankle, from the foot to the contact zone of the boot with the ground or a gliding support. During practice of any of the above-mentioned sports, the contact zone, which is localized in a so-called metatarsophalangeal zone, must remain constantly in contact with the support and/or the ground, even when the user lifts the heel of a foot to make a stride, and/or to displace the center of gravity with respect to the direction of the gliding support. As a result, the portion of the foot and of the boot located behind the metatarsophalangeal zone forms an angle with the portion of the boot located in front of such zone during the lifting. This angle translates into a bending of the user's foot, and therefore of the boot, in the metatarsophalangeal zone.

Therefore, it must be noted that a boot adapted to the aforementioned sports must first meet the requirement for sufficient flexibility in the metatarsophalangeal zone to allow as natural a movement as possible.

The transmission of the forces coming from the user's leg to the metatarsophalangeal zone, which represents the impulse zone of the foot with respect to the ground and/or support, constitutes the second requirement to be met by a boot intended for the aforementioned sports. To prevent a loss of forces due to shock absorption and local deformation, it is necessary to stiffen the base structure of the boot.

In addition, it is important to avoid any movement of the foot with respect to the boot. This results, in particular, into the necessity of a satisfactory retention of the heel inside the boot.

To summarize, a boot adapted to the above-mentioned sports must meet various and incompatible requirements, which, at the outset, cannot be accomplished without being detrimental to at least one of the aforementioned aspects.

That is what numerous approaches, which have been attempted, were intended to solve. For example, it is known to provide a cross-country ski boot with a substantially non-flexible sole. Of course, the resulting problem is that a natural movement of the foot is no longer achievable, since the sole resists the natural bending movement in the metatarsophalangeal zone.

Another approach known, for example, from the document IT 195 621, consists of the arrangement of an edge ascending from the external sole which surrounds the entire boot. However, this construction does not allow a natural movement of the foot.

Yet another approach known, for example, from the document EP-A-309 437, consists of the arrangement of a more or less flexible sole and of a flexible stiffener, which surrounds the heel. However, this construction allows neither a satisfactory heel retention, nor an efficient transmission of the forces coming from the user's leg.

SUMMARY OF THE INVENTION

Therefore, an object of the present invention is to provide a boot whose improved design remedies the disadvantages of the prior art and conciliates the conflicting requirements, and which improves the heel retention while enabling a natural movement of the foot and being simple and inexpensive to construct.

The central idea of the present invention is to improve the retention of the heel of the foot by providing, in this area, a stiffener that is rigid and substantially non-flexible. It is then the rigidity of the stiffener that allows both a satisfactory heel retention and a transmission of the forces. Furthermore, this construction allows flexibility of the external sole in the so-called metatarsophalangeal zone and a more natural movement of the foot.

According to a first aspect of the present invention, the rigid stiffener extends along at least one side of the boot, substantially up to the so-called metatarsophalangeal bending zone. There results, from the reinforcement of the rear portion of the boot, a satisfactory transmission of the forces coming from the user's leg to the front portion of the foot which is constantly in contact with the ground or the gliding support.

According to a second aspect of the invention, the rigid stiffener, and essentially the rear portion of the base of the foot, surrounds the heel like a shell. This construction also allows for a better transmission of the forces, especially in the transverse direction, due to the reinforcement and to the form of the shell-shaped rear portion of the boot, while maintaining a flexibility of the boot in the metatarsophalangeal zone.

These constructions permit a better control of the ski through the heel retention and, at the same time, a general gain of energy and a direct transmission of the forces by eliminating the parasitic deformations of the sole and of the boot, which parasitic deformations are unnecessary for propulsion by the typical movements of the aforementioned sports.

BRIEF DESCRIPTION OF DRAWINGS

In any event, the invention will be better understood, and other characteristics thereof will become apparent from the description that follows, with reference to the annexed schematic drawing illustrating, by way of a non-limiting example, a plurality of embodiments, and in which.

DETAILED DESCRIPTION OF THE INVENTION

Figure 1:
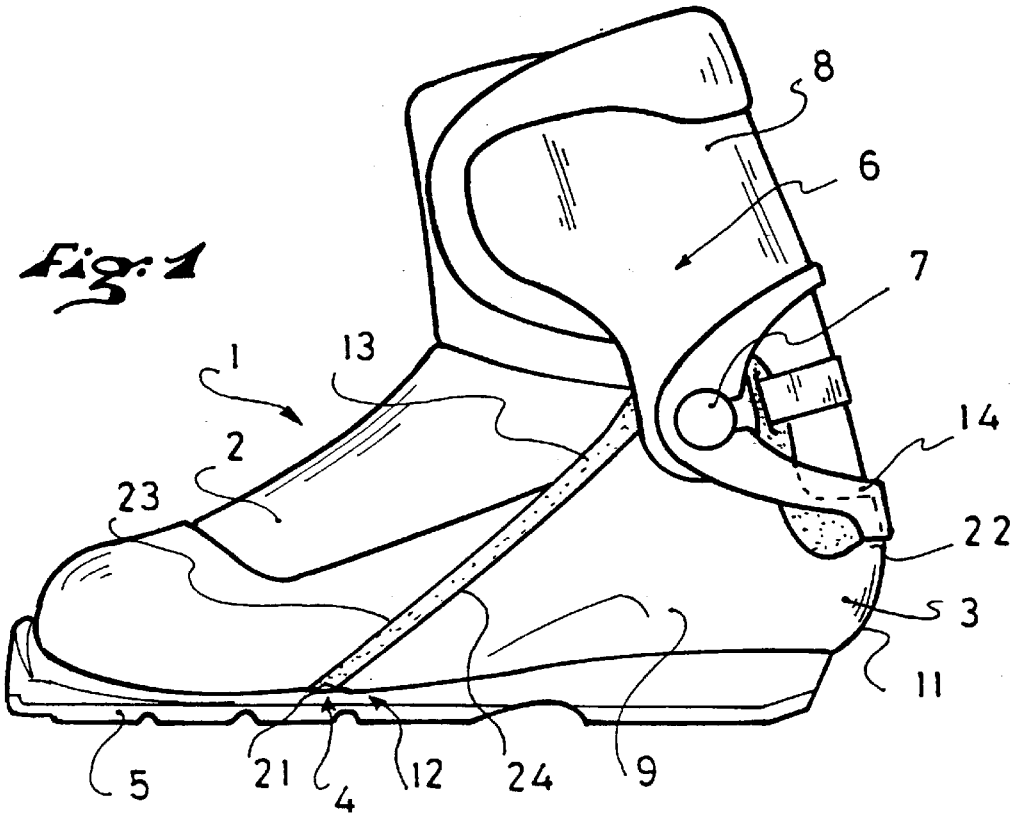
FIG. 1 is a lateral view of a first embodiment of the present invention.
Figure 2:
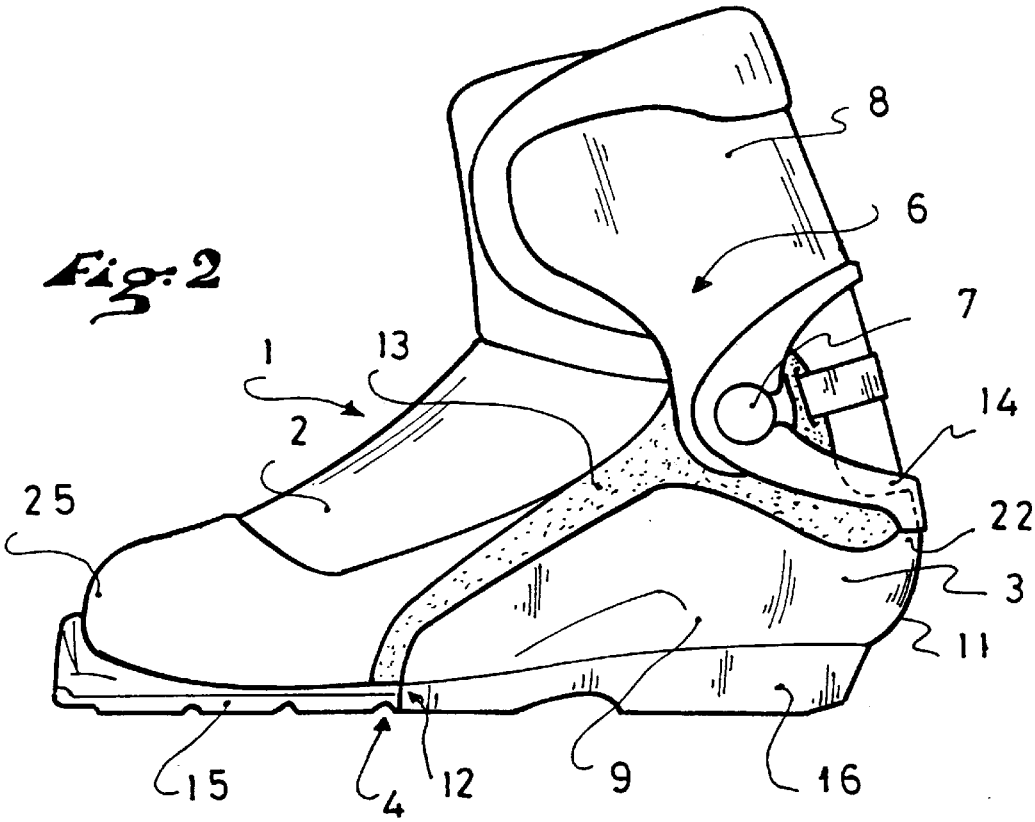
FIG. 2 is a lateral view of a second embodiment of the present invention.

A boot 1 adapted to cross-country skiing, especially for the so-called skating style, is shown in FIGS. 1 and 2. However, the present invention also applies to all sports requiring a movement of the foot, such as snowshoeing, cross-country skiing, telemark skiing and hiking, and/or gliding sports such as snowboarding, ice skating, roller skating, etc., for example. For simplification, the following description is made in reference to a boot for cross-country skiing.

The boot 1 shown has, in a known manner, an upper 2, an external sole 5 and a journalled collar 8, which is fixed to the upper via a journal axis 7. The construction of a boot upper for cross-country skiing is well known in the state of the art and will not be explained in detail in the description.

The boot 1 shown in FIGS. 1 and 2 is provided with a first rear stiffener 13 made of a sufficiently flexible material to permit an attachment by stitching of this flexible stiffener 13 on the upper 2.

According to the present invention, the boot 1 additionally has a second stiffener 3, which is more rigid than the flexible stiffener 13, and is, in fact, substantially non-flexible. The rigid stiffener 3 surrounds the heel 11 of the boot 1, i.e., the portion of the boot that accommodates the heel of the wearer, with two respective lateral 9 and medial 10 walls, and with a rear wall in the area of the heel 11. By lateral wall and medial wall, respectively, is meant each of the walls of the stiffener arranged toward the outside and toward the inside, respectively, of the foot or of the boot. In the example shown, the rigid stiffener extends forwardly, substantially up to the metatarsophalangeal bending zone 4 of the foot.

The reinforcement of the boot 1 by means of a rigid stiffener 3 is therefore limited to a zone comprised between the heel 11 and the metatarsophalangeal bending zone 4. The user's foot is therefore held appropriately on the side of the heel 11, while maintaining a flexibility of the boot 1 in the metatarsophalangeal bending zone 4, which enables an almost natural movement of the foot.

The rigid stiffener 3 has a maximum height that does not exceed that of the area located substantially beneath the zone of the ankle 6, and is especially lower than the level of this zone.

In the example of FIG. 1, the stiffener 3 extends vertically, substantially up to the journal zone of the ankle, and includes the journal axis 7 of the journal collar 8.

In the example of FIG. 2, the maximum height of the stiffener 3 is, on the contrary, lower than the level of the journal axis 7 which, therefore, is only attached on the first flexible stiffener 13, which makes it possible to have more freedom in the transverse direction, in the area of the collar, due to the greater flexibility of the material.

In any event, the maximum height of the stiffener 3 is selected such that the natural movement of the ankle 6 is not hindered.

Extending from the zone beneath the zone of ankle 6 representing the maximum height of the stiffener 2 in the transverse direction, the height of each of the walls 9, 10, decreases progressively toward the front of the stiffener 3. At the front end 12 of the stiffener 3, each wall 9, 10, joins the upper edge 21 of the external sole 5. In the example shown in FIG. 1, the lateral wall 9 decreases in a substantially continuous manner while forming an angle of approximately 45° with the upper edge 21 of the external sole. The medial wall 10 can have the same shape.

Extending from the zone beneath the zone of ankle 6 representing the maximum height of the stiffener 3 in the transverse direction, the lateral wall 9, as well as the medial wall 10, also decreases rearwardly, in the area of heel 11, for a better comfort of the foot.

Furthermore, the stiffener 3 can form an abutment 22 for supporting an elastic buckle 14 which surrounds the ankle 6 in the manner of a spur which provides an elastic return of the collar.

Moreover, this buckle 14 is known and does not constitute an essential element for the present invention. That is the reason why the buckle 14 will not be described in detail.

In view of the rigidity of the stiffener 3, which can make it impossible to attach the rigid stiffener 3 directly on the fabric and/or leather of the upper 2, it can be advantageous to attach the rigid stiffener 3 by adhesive and/or riveting, for example, on the flexible stiffener 13 which has a sufficient flexibility enabling its linkage, for example, by adhesive, stitching and/or riveting on the upper 2. The flexible stiffener 13 additionally permits a padding of the rigid stiffener 3, which prevents local pressures on the user's foot.

Finally, the two-layer structure of the stiffener 3, 13, provides the latter with extra stiffness, in addition to the sum of the two individual stiffnesses by means of the "wood core plywood" effect obtained.

Preferably, the rigid stiffener 3 covers the flexible stiffener 13 only partially, by leaving exposed an edge 23 which extends beyond at least the upper edge 24 of the lateral wall of the rigid stiffener 3, so as to facilitate the attachment or linkage thereof on the upper.

The preferred materials for the rigid stiffener 3 are plastic materials that can be reinforced by glass fibers or carbon fibers, for example, or metallic materials. In any event, all materials that basically guarantee a quasi non-flexibility of the rigid stiffener 3 are adapted to be used. The preferred rigidity of the rigid stiffener is comprised between 260 MPa (Mega Pascal), which corresponds to the Pebax 6333 Modulus of elasticity, and 200 GPa (Giga Pascal), which corresponds to the modulus of elasticity of a glass/carbon fiber composite.

In addition to the height of the rigid stiffener 3, the main difference between the boots of FIGS. 1 and 2 lies in the construction of the external sole.

Indeed, the external sole according to the embodiment shown in FIG. 2 is made in two portions, one front portion 15 and one rear portion 16. The front portion 15 essentially extends from the front end 24 of the boot 1 up to the metatarsophalangeal bending zone 4. This front portion 15 is sufficiently flexible to allow for an almost natural bending in the bending zone 4.

The rear portion 16 of the external sole and the rigid stiffener 3 form a monoblock and preferably single material assembly. This construction has advantages with respect to the assembly of the rear portion 16 of the sole and of the rigid stiffener 3 in one piece on the upper 2, the imperviousness of the rear lower portion of the boot 1, especially in the zone which conventionally represents the linkage between the external sole and the stiffener, and also with respect to a further improved reinforcement, in relation to the embodiment, described with reference to FIG. 1, of the rear portion and of the heel of the boot 2.

Preferred constructions of the rigid stiffener 3 will now be described in detail, with reference to FIGS. 3 and 4.

The rigid stiffener 3 shown in FIG. 3 has the shape of a shell having a "U"-shaped transverse section and fully surrounding the heel, i.e., laterally, at the rear, as well as underneath, and at a maximum height that is well below the level of the zone of the ankle 6. The preferred height is comprised between about 2 centimeters and 4 centimeters. The embodiment according to FIG. 2, i.e., the monoblock, i.e., unitary, construction of the rear portion of the external sole with the rigid stiffener 3, is symbolized by dotted lines.

Figure 3:
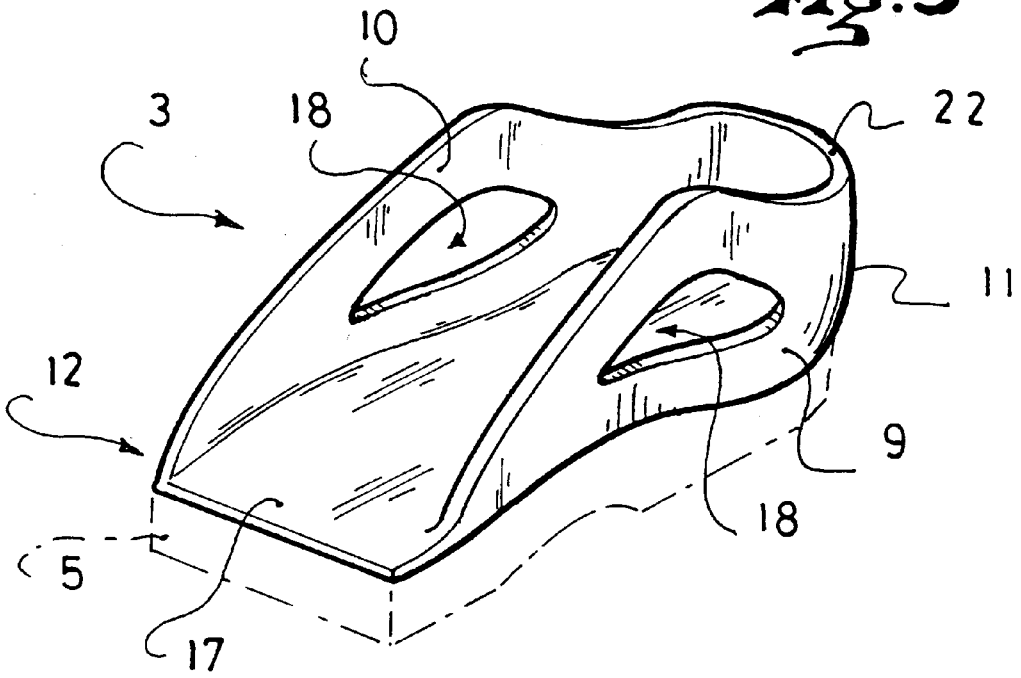
FIG. 3 shows a stiffener according to the present invention.

The rigid stiffener 3 shown in FIG. 3 fully covers the base of the foot. Of course, the stiffener 3 could also only partially cover the portion of the base of the foot, for example by forming a hollow space, or one or more recesses in the base portion 17 of the rigid stiffener 3. In any event, the construction of the rigid stiffener 3 according to the example shown in FIG. 3 permits a surrounding of the heel and of the rear portion of the foot base in the manner of a shell. By tightening a tightening system, which is not shown in the figures, and which can be constituted by a lacing, for example, the foot is pressed in the shell formed by the rigid stiffener 3 and is then appropriately retained on the heel.

As shown in FIG. 3, the lateral wall 9 and/or the medial wall 10 of the rigid stiffener 3 can be provided with recesses or through-openings 18, which enables the reduction of the weight of the rigid stiffener 3 while maintaining the rigidity thereof.

Figure 4:
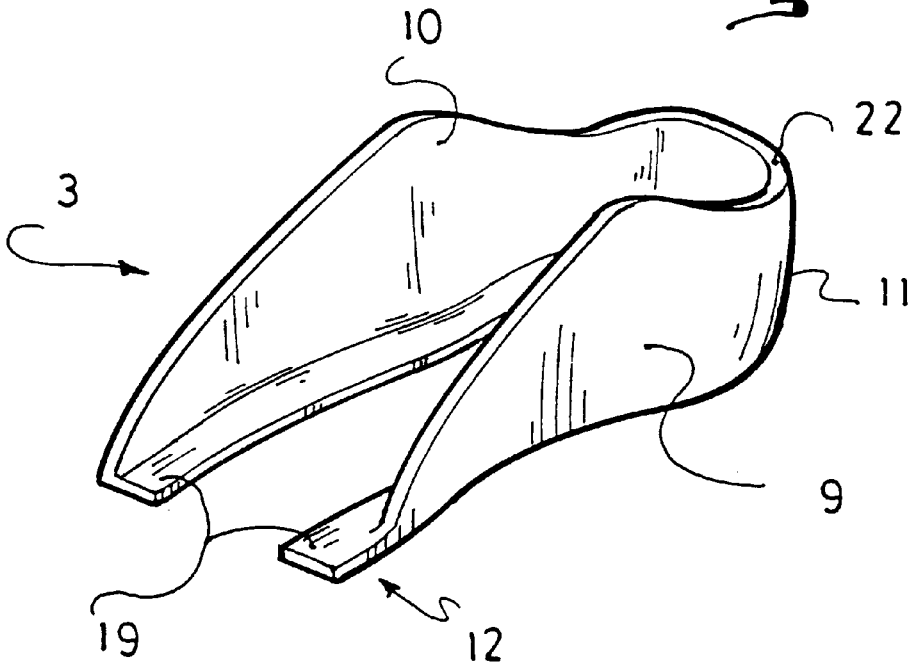
FIG. 4 shows another stiffener according to the present invention.

In the example shown in FIG. 4, the rigid stiffener 3 without the bottom 17, and provided with edges 19 extends horizontally from the lower edges of the lateral wall 9 and medial wall 10, respectively, toward the interior. The transverse edges 19 serve to attach the stiffener by insertion between a first layer of the upper 2 and the external sole. In addition, these transverse edges 19 participate in the stiffening of the rigid stiffener 3, especially during torsion. Of course, these transverse edges 19 can be provided to be sufficiently large, such that they join one another by leaving almost only a slit therebetween.

Figure 3A:
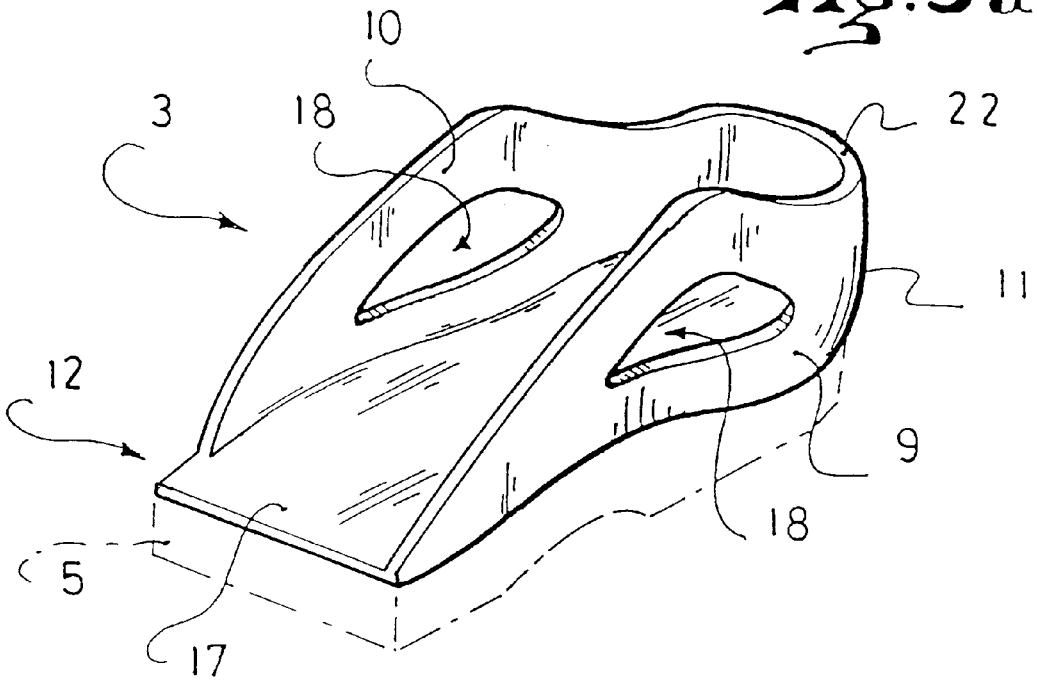
FIG. 3*a* shows an alternative to the stiffener of FIG. 3.
Figure 4A:
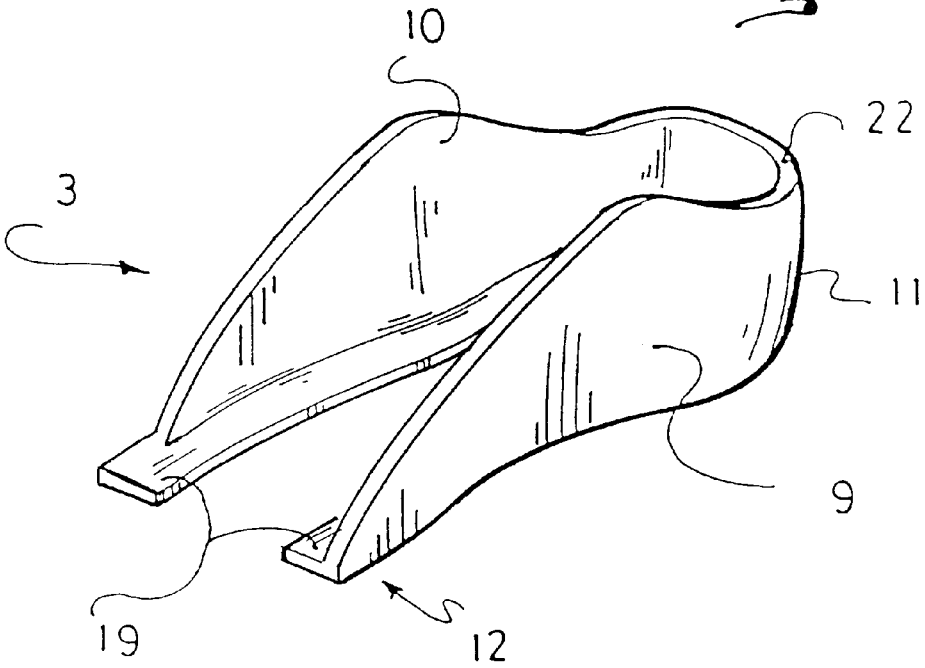
FIG. 4*a* shows an alternative to the stiffener of FIG. 4.

In FIGS. 3 and 4, the medial wall 10 is shown to extend longitudinally further than the lateral wall 10. Alternatively, as shown in FIGS. 3*a* and 4*a*, the lateral wall 9 of the rigid stiffener 3, can be made to extend further in the longitudinal direction than the medial wall 10 by respecting the orientation of the natural bending line in the metatarsophalangeal zone 4, which forms an acute angle with the longitudinal axis of a foot.

In certain cases, it can be advantageous to extend the medial wall 10 with respect to the lateral wall 9 to create an improved support on the medial side of the boot.

What is claimed is:

1. A sport boot comprising:

an external sole, said external sole including a rear portion;

an upper provided with a heel stiffener adapted to surround substantially the heel and to surround substantially a rear portion of a base of a heel of a wearer of the boot in the manner of a shell, said heel stiffener including a medial side and a lateral side, said heel stiffener and said rear portion of said external sole forming a monoblock assembly;

said heel stiffener being rigid and substantially non-flexible and at least one of said medial side and said lateral side extending longitudinally forwardly and terminating substantially at a metatarsophalangeal bending zone.

2. A sport boot according to claim 1, wherein:

said external sole including a front portion extending forwardly of said metatarsophalangeal bending zone, said front portion being more flexible than said rear portion to facilitate bending of said sole.

3. A sport boot according to claim 2, wherein:

said front portion and said rear portion of said external sole are made of two separate pieces of material.

4. A sport boot comprising:

an external sole, said external sole including a rear portion;

an upper provided with a heel stiffener, said heel stiffener having a medial side and a lateral side, said heel stiffener extending continuously from said medial side to said lateral side beneath the heel of the wearer of the boot, and from said medial side to said lateral side at a rear portion of the heel of the wearer of the boot;

said heel stiffener and said rear portion of said external sole forming a monoblock assembly;

said heel stiffener being rigid and substantially non-flexible and at least one of said medial side and said lateral side extending longitudinally forwardly and terminating substantially at a metatarsophalangeal bending zone.

5. A sport boot according to claim 4, wherein:

said heel stiffener is made from a material having a rigidity between 260 MPa and 200 GPa.

6. A sport boot according to claim 4, wherein:

said heel stiffener extends upwardly to a height beneath a zone corresponding to an ankle of the foot of the wearer.

7. A sport boot according to claim 4, wherein:

a flexible collar is positioned with respect to said upper for pivoting about an axis;

said heel stiffener extends upwardly to a height beneath said axis.

8. A sport boot according to claim 4, wherein:

said medial wall extends longitudinally forwardly beyond said lateral wall.

9. A sport boot according to claim 4, wherein:

said lateral wall extends longitudinally forwardly beyond said medial wall.

10. A sport boot according to claim 4, wherein:

said heel stiffener has a medial wall on said medial side and a lateral wall on said lateral side;

said heel stiffener further has a rear wall adapted to be positioned rearward of the heel of the foot of the wearer, said rear wall extending between said lateral wall and said medial wall;

said rear wall having a height lower than the greatest height of said heel stiffener.

11. A sport boot according to claim 10, wherein:

said greatest height of said heel stiffener is in a zone substantially beneath an ankle of the foot of the wearer.

12. A sport boot according to claim 4, wherein:

said heel stiffener has a greatest height in a zone substantially beneath an ankle of the foot of the wearer.

13. A sport boot according to claim 4, wherein:

said heel stiffener has a front end at said metatarsophalangeal bending zone;

said heel stiffener has a medial wall on said medial side and a lateral wall on said lateral side, each of said medial wall and said lateral wall has a respective upper edge;

said upper edge of at least one of said medial wall and said lateral wall extend(s) continuously downwardly and joins an outer edge portion of said external sole at said front end of said stiffener.

14. A sport boot according to claim 4, further comprising:

a second stiffener made of a material more flexible than said heel stiffener, said rigid heel stiffener at least partially covering said second stiffener.

15. A sport boot according to claim 14, wherein:

said rigid heel stiffener is fixed on said second stiffener.

16. A sport boot according to claim 15, wherein:

said second stiffener is affixed to said upper and said rigid heel stiffener is affixed to said second stiffener.

17. A sport boot according to claim 4, wherein:

a flexible stiffener is affixed to said upper below said rigid heel stiffener, thereby externally exposing an upper border of said flexible stiffener beyond an upper periphery of said rigid heel stiffener.

18. A sport boot according to claim 17, wherein:

said flexible stiffener is affixed by stitching to said upper;

said rigid heel stiffener is affixed to said flexible stiffener by adhesive.

19. A sport boot according to claim 17, wherein:

said flexible stiffener is affixed by stitching to said upper;

said rigid heel stiffener is affixed to said flexible stiffener by rivets.

20. A sport boot according to claim 4, wherein:

said external sole including a front portion extending forwardly of said metatarsophalangeal bending zone, said front portion being more flexible than said rear portion to facilitate bending of said sole.

21. A sport boot according to claim 20, wherein:

said front portion and said rear portion of said external sole are made of two separate pieces of material.

* * * * *